US009611655B2

(12) United States Patent
Anspach et al.

(10) Patent No.: US 9,611,655 B2
(45) **Date of Patent: *Apr. 4, 2017**

(54) INTERLOCKING FLOOR PANELS WITH HIGH PERFORMANCE LOCKING PROFILES

(71) Applicant: ARMSTRONG WORLD INDUSTRIES, INC., Lancaster, PA (US)

(72) Inventors: Kean M. Anspach, Quarryville, PA (US); John R. Eshbach, Jr., Marietta, PA (US); Brent L. Stoll, Lititz, PA (US); Sunil Ramachandra, Lancaster, PA (US)

(73) Assignee: AFI Licensing LLC, Lancaster, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/994,871

(22) Filed: Jan. 13, 2016

(65) Prior Publication Data

US 2016/0138274 A1 May 19, 2016

Related U.S. Application Data

(63) Continuation of application No. 14/541,992, filed on Nov. 14, 2014, now Pat. No. 9,249,582.

(51) Int. Cl.
*E04F 15/02* (2006.01)
*E04C 2/30* (2006.01)
(Continued)

(52) U.S. Cl.
CPC ..... *E04F 15/02038* (2013.01); *D06N 1/00* (2013.01); *E04C 2/20* (2013.01);
(Continued)

(58) Field of Classification Search
CPC ..... E04F 15/107; E04F 15/02038
See application file for complete search history.

(56) References Cited

U.S. PATENT DOCUMENTS 4,333,987 A 6/1982 Kwart et al.
4,804,429 A 2/1989 Appleyard et al.
(Continued)

FOREIGN PATENT DOCUMENTS

EP 2339092 6/2011

OTHER PUBLICATIONS

International Search Report for corresponding Application No. PCT/US2015/060793, mailed Feb. 11, 2016.

*Primary Examiner* — Beth Stephan

(57) ABSTRACT

A floating floor system includes a plurality of floor panels, each of the floor panels comprising a base layer, a wear layer forming an uppermost surface of the floor panel, a first locking edge portion having a first locking profile that includes a first channel having a first channel floor, the first locking edge portion being formed by the wear layer and the base layer, the first locking profile further comprising a first channel bed thickness measured between the uppermost surface and the first channel floor, and wherein the wear layer forms at least 5% of the first channel bed thickness, and a second locking edge portion having a second locking profile that includes a second vertical ridge, the second locking edge portion located opposite the first locking edge portion.

19 Claims, 4 Drawing Sheets

(51) Int. Cl.

| | |
|---|---|
| ***E04C 2/24*** | (2006.01) |
| ***E04C 2/20*** | (2006.01) |
| ***D06N 1/00*** | (2006.01) |
| ***E04F 15/10*** | (2006.01) |
| ***E04C 2/26*** | (2006.01) |

(52) U.S. Cl.

CPC ..... *E04C 2/24* (2013.01); *E04C 2/26* (2013.01); *E04C 2/30* (2013.01); *E04F 15/105* (2013.01); *E04F 15/107* (2013.01); *D06N 2211/066* (2013.01); *D10B 2503/04* (2013.01); *E04F 2201/0146* (2013.01); *E04F 2201/0161* (2013.01)

(56) References Cited

U.S. PATENT DOCUMENTS

| | | | | |
|---|---|---|---|---|
| 6,418,683 | B1 | 7/2002 | Martensson et al. | |
| 6,591,568 | B1 * | 7/2003 | Pålsson ..... | E04F 15/02 52/50 |
| 8,006,460 | B2 | 8/2011 | Chen et al. | |
| 8,293,058 | B2 | 10/2012 | Pervan | |
| 8,365,499 | B2 | 2/2013 | Nilsson | |
| 8,720,151 | B2 | 5/2014 | Pervan | |
| 2002/0189183 | A1 | 12/2002 | Ricciardelli | |
| 2003/0024199 | A1 | 2/2003 | Pervan et al. | |
| 2003/0033777 | A1 | 2/2003 | Thiers et al. | |
| 2003/0145549 | A1 | 8/2003 | Palsson et al. | |
| 2004/0211144 | A1 | 10/2004 | Stanchfield | |
| 2006/0101769 | A1 | 5/2006 | Pervan et al. | |
| 2006/0179773 | A1 | 8/2006 | Pervan | |
| 2007/0175156 | A1 | 8/2007 | Pervan et al. | |
| 2008/0028707 | A1 | 2/2008 | Pervan | |
| 2008/0168736 | A1 | 7/2008 | Pervan | |
| 2009/0193741 | A1 * | 8/2009 | Cappelle ..... | E04F 15/02 52/309.1 |
| 2009/0193748 | A1 | 8/2009 | Boo et al. | |
| 2009/0249733 | A1 | 10/2009 | Moebus | |
| 2010/0281810 | A1 | 11/2010 | Ruland | |
| 2011/0154665 | A1 | 6/2011 | Pervan et al. | |
| 2011/0167744 | A1 | 7/2011 | Whispell et al. | |
| 2012/0240502 | A1 | 9/2012 | Wilson et al. | |
| 2012/0291387 | A1 | 11/2012 | Keane | |
| 2012/0317911 | A1 | 12/2012 | Huang | |
| 2013/0104478 | A1 | 5/2013 | Meersseman | |
| 2013/0111843 | A1 | 5/2013 | Litral | |
| 2013/0145707 | A1 | 6/2013 | Pervan | |
| 2013/0263547 | A1 | 10/2013 | Boo | |

* cited by examiner

INTERLOCKING FLOOR PANELS WITH HIGH PERFORMANCE LOCKING PROFILES

CROSS-REFERENCE TO RELATED APPLICATIONS

This application is a continuation of U.S. patent application Ser. No. 14/541,992 filed on Nov. 14, 2014. The disclosure of the above application is incorporated herein by reference.

FIELD OF THE DISCLOSURE

The field of the present invention relates to locking floor panel systems in which the floor panels are formed by layers of different materials.

BACKGROUND

Interlocking flooring of various types is well known. Such flooring is often referred to as "floating" because none of the flooring panels, whether they are elongated rectangular boards or less elongated panels, are secured to the subfloor.

Perhaps the most well-known type of locking flooring is tongue-in-groove floor boards, in which the tongue-in-groove feature provides locking against vertical movement along the two long edges of elongated floor boards—tongue-in-groove flooring did not originally have any locking features along the two short edges of the floor boards. Over time, the long edges of floor panels have gained both horizontal and vertical locking features, as have the short edges. U.S. Pat. No. 8,293,058 describes one type of interlocking floor panels that has both long and short interlocking edges. As is recognized, the locking features may be used with many different types of materials, such as floor panels which have a rigid high density fiberboard (HDF) core, with such HDF core panels having either a hard surface coating or a resilient plasticized vinyl surface coating, or floor panels which have a resilient core with a resilient plasticized vinyl surface.

For floor panels which have a resilient core, it is also known that certain types of locking features do not provide the same longevity for the flooring as they do for floor panels having stiffer core materials. The resilient core material that makes such floor panels desirable also makes the floor panels more susceptible to separation, pulling apart, and/or curling at the locking edges.

One type of interlocking floor panel that has been introduced in an attempt to overcome this problem is described in U.S. Pat. No. 8,365,499. In this type of floor panel, one which has a resilient core material, the shape of the locking features has been altered to gain a better locking coupling between adjacent floor panels. However, one result of this alteration to the locking features is that the floor panels need to be bent and rolled into locking engagement with a previously set floor panel. The necessary rolling for installation adds both time and difficulty to the installation process, especially for individuals, such as do-it-yourself homeowners, who are not experienced with the installation technique.

For these reasons, an improved design for floor panels having a resilient core material is desired. Embodiments of the present invention are designed to meeting these needs.

SUMMARY

In some embodiments, the present invention is directed to a floating floor system comprising: a plurality of floor panels, each of the floor panels comprising: a base layer; a wear layer atop the base layer, the wear layer forming an uppermost surface of the floor panel; a first locking edge portion having a first locking profile that includes a first channel having a first channel floor, the first locking edge portion being formed by the wear layer and the base layer, the first locking profile further comprising a first channel bed thickness measured between the uppermost surface and the first channel floor, and wherein the wear layer forms at least 5% of the first channel bed thickness; and a second locking edge portion having a second locking profile that includes a second vertical ridge, the second locking edge portion located opposite the first locking edge portion; and wherein the floor panels are arranged in a mechanical interlocked arrangement such that the first edge portions of the floor panels mate with the second edge portions of adjacent ones of the floor panels.

In other embodiments, the present invention is directed to an interlocking floor panel comprising: a base layer; a wear layer atop the base layer, the wear layer forming an uppermost surface of the interlocking floor panel; a first locking edge portion having a first locking profile that includes a first channel having a first channel floor, the first locking edge portion being formed by the wear layer and the base layer, the first locking profile further comprising a first channel bed thickness measured between the uppermost surface and the first channel floor, and wherein the wear layer forms at least 5% of the first channel bed thickness; and a second locking edge portion having a second locking, the second locking edge portion located opposite the first locking edge portion.

In other embodiments, the present invention is directed to an interlocking floor panel comprising: a linoleum base layer; a vinyl wear layer atop the linoleum base layer, the vinyl wear layer forming an uppermost surface of the interlocking floor panel; a first locking edge portion having a first locking profile that includes a first channel having a first channel floor, the first locking edge portion being formed by the vinyl wear layer and the linoleum base layer, the first locking profile further comprising a first channel bed thickness measured between the uppermost surface and the first channel floor; and a second locking edge portion having a second locking, the second locking edge portion located opposite the first locking edge portion.

Accordingly, an improved interlocking floor panel and floor panel system are disclosed. Advantages of the improvements will be apparent from the drawings and the description of the preferred embodiments.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION

Figure 1:
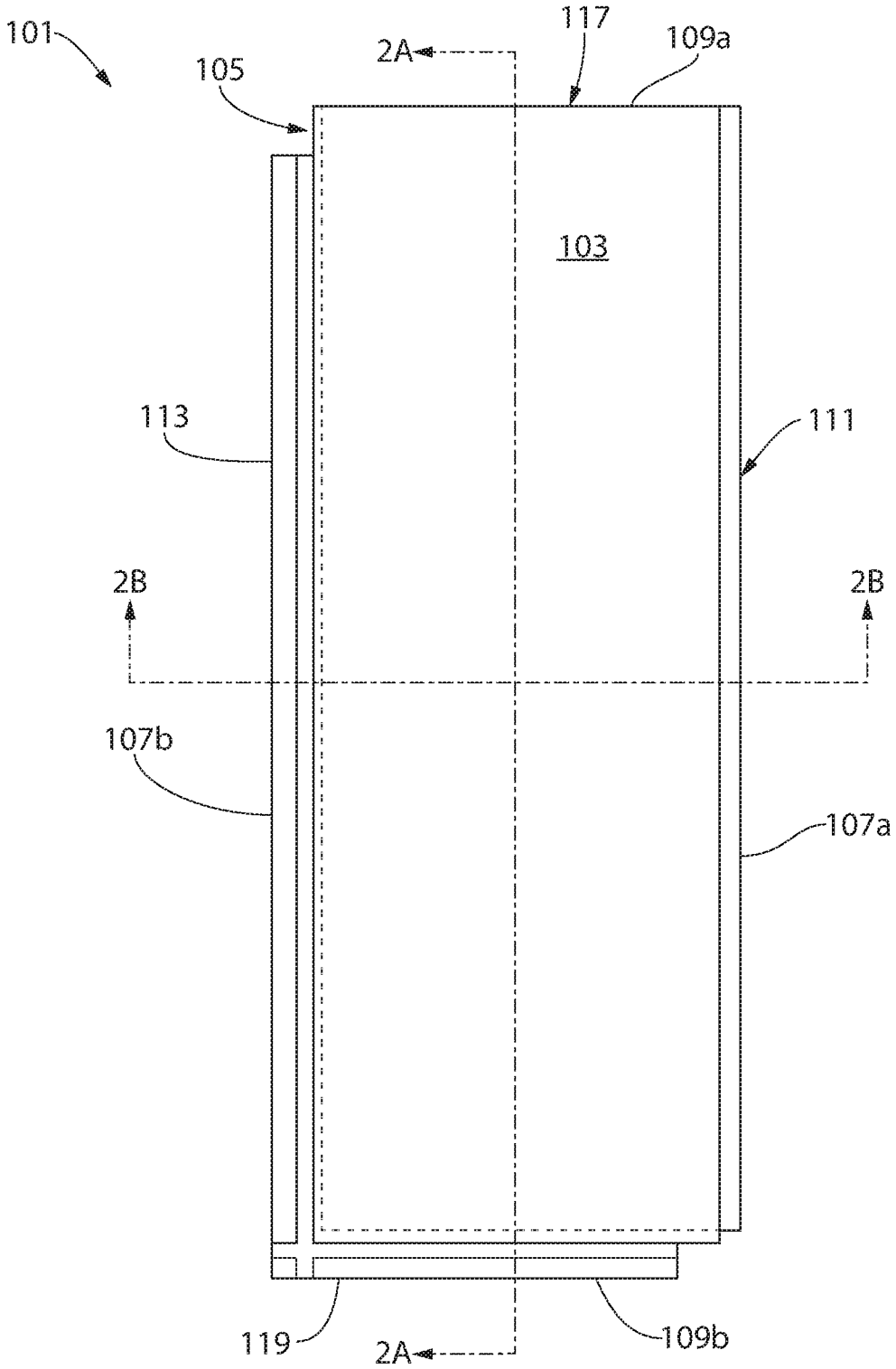
FIG. 1 shows a top plan view of an interlocking floor panel having a resilient base layer and a wear layer having a higher degree of stiffness.

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments.

As used herein, the term "rigid" means "unyielding; not pliant or flexible".

As used herein, the terms "panel", "tile", and "board" may be used interchangeably, and where there is a size or compositional difference, the difference will be expressly stated.

The following description is provided using luxury vinyl flooring as an exemplary embodiment. Luxury vinyl flooring, such as luxury vinyl tile (LVT), is a category of thermoplastic based flooring covering products that may replicate natural materials such as wood, stone, slate, marble, granite, and others. Such products strive to be more cost effective and offer consumers increased durability and lower maintenance in contrast to their natural counterparts while delivering an equivalent look and feel. LVT has particular applicability as a commercial flooring product where it may be subjected to high use and wear. Accordingly, it is desirable to provide a heavy gauge wear layer of suitable thickness to provide durability and longevity.

The LVT of the exemplary embodiment includes a resilient base layer formed from any thermoplastic-based composition or mixture suitable for producing resilient laminated flooring. By way of example, the resilient base layer may be a vinyl composition such as PVC mixed with fillers, plasticizers, binders, stabilizers, and/or pigments. In certain embodiments, the resilient base layer may be formed from a plurality of sub-layers, with at least one of the sub-layers having a different composition and different properties. The resilient base layer may generally have a thickness ranging from about and including 40 mils (thousandths of an inch) to about and including 250 mils. In some exemplary embodiments, the resilient base layer may have a thickness from about 75 mils to about 145 mils. In some exemplary embodiments, the resilient base layer may have a thickness about 100 mils.

In some embodiments, the plasticizer comprises an ester type plasticizer. In some embodiments, the ester type plasticizer is selected from: butyl benzyl phthalate, di isononyl phthalate, di octyl terephthalate, tributyl phosphate, dioctyl phthalate, dipropylene glycol dibenzoate, phenyl phosphate, dibutyl tartrate, amyl tartrate, butyl benzyl benzoate, dibutyl sebacate, dioctyl adipate, didecyl adipate and a combination of two or more thereof. In some embodiments, the plasticizer comprises epoxidized soybean oil.

In some embodiments, the plasticizer is a phthalate plasticizer. In some embodiments, the phthalate plasticizer is selected from: dimethyl phthalate, diethyl phthalate, diallyl phthalate, di-n-propyl phthalate, di-n-butyl phthalate, diisobutyl phthalate, butyl cyclohexyl phthalate, di-n-pentyl phthalate, dicyclohexyl phthalate, butyl benzyl phthalate, di-n-hexyl phthalate, diisohexyl phthalate, diisoheptyl phthalate, butyl decyl phthalate, di(2-ethylhexyl) phthalate, di(n-octyl) phthalate, diisooctyl phthalate, n-octyl n-decyl phthalate, diisononyl phthalate, di(2-propylheptyl) phthalate, diisodecyl phthalate, diundecyl phthalate, diisoundecyl phthalate, ditridecyl phthalate, diisotridecyl phthalate and a combination of two or more thereof.

The LVT of the exemplary embodiment further includes a wear layer formed by a vinyl film, which provides a wear layer that has a higher degree of stiffness than the resilient base layer. In certain embodiments, the vinyl film may be a film produced from a vinyl composition, e.g., polyvinyl chloride, with no or substantially no plasticizer (not more than 3%, and for some embodiments, less than 1%). In other embodiments, the wear layer may be formed of other suitably stiff material layers and/or films.

In certain embodiments, the wear layer has a thickness of at least 2 mils or more to provide a durable and long lasting wear layer for protecting resilient base layer. In some exemplary embodiments, the wear layer may have a thickness of 6 mils, 12 mils, 20 mils, or 22 mils. In yet other embodiments, the wear layer may have a thickness of between about 15 mils and 40 mils. For certain applications of flooring, a thicker wear layer is desirable, so that the LVT may be more suitable for commercial applications to provide satisfactory wear resistance performance to withstand heavy foot traffic and/or other traffic.

A system and process for adhering an RVF as a wear layer on a resilient base layer is disclosed in U.S. patent application Ser. No. 14/108,019, filed Dec. 16, 2013. As described therein, in certain embodiments the wear layer may include a pre-embossed, pre-coated, and/or other type of film over an RVF layer. In certain embodiments, the wear layer may include a UV cured urethane top coating to provide enhanced scratch resistance.

Turning to FIG. 1, a rectangular floor panel 101 is shown. In this exemplary embodiment, the uppermost surface 103 of the floor panel 101 is symmetric to the bottom surface 105 of the floor panel 101. The floor panel 101 as shown has long edges 107*a*, 107*b* and short edges 109*a*, 109*b*. Each of the long edges 107*a*, 107*b* are configured with a first locking profile 111 and a second locking profile 113, respectively, with the two locking profiles 111, 113 being complementary in shape to the other locking profile 111, 113, respectively, so that the first locking profile 111 of a first floor panel may couple in locking engagement with the second locking profile 113 of a second floor panel. Similarly, each of the short edges 109*a*, 109*b* may be configured with a third locking profile 115 and a fourth locking profile 117, respectively, with the two locking profiles 115, 117 being complementary in shape to the other locking profile 115, 117, respectively, so that the third locking profile 115 of a first floor panel may couple in locking engagement with the second locking profile 117 of a second floor panel. In certain embodiments, one of the long edges 107*a*, 107*b* or the short edges 109*a*, 109*b* may be configured to be of the "fold-and-lock" type, and the other of long edges 107*a*, 107*b* and the short edges 109*a*, 109*b* may be configured as a "push-and-lock" type. Both types of locking engagement side profiles are well known in the art, and either type may be placed along the short edge or the long edge of a floor panel.

The length ratio of the long edges 107*a*, 107*b* of the floor panel 101 to the short edges 109*a*, 109*b* of the floor panel 101 may vary in accordance with design choice. In certain embodiments, the long edges 107*a*, 107*b* may be significantly longer than the short edges 109*a*, 109*b*, and in other embodiments, all four sides 107*a*, 107*b*, 109*a*, 109*b* may be of equal length. When all four sides are equal, the locking profiles are the only features which distinguish the 'long edges' from the 'short edges'.

Figure 2A:
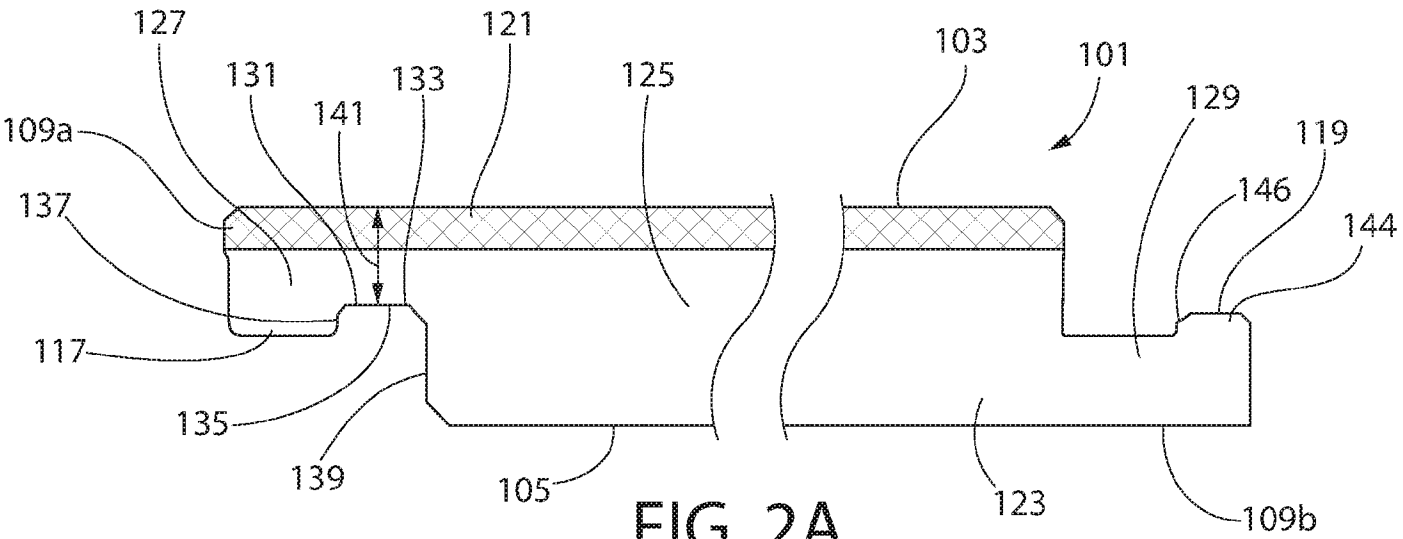
FIG. 2A shows a sectional view of the floor panel along the line 2A-2A of FIG. 1.

As shown in FIG. 2A, the uppermost surface 103 of the floor panel 101 is formed by the wear layer 121, and the bottom surface 105 of the floor panel 101 is formed by the resilient base layer 123. In certain embodiments, each of the wear layer 121 and the resilient base layer 123 may include additional sub-layers. The wear layer 121 and the resilient base layer 123, in combination, form a body portion 125 of the floor panel 101, and the wear layer 121 and the resilient base layer 123, in combination, also form the locking edge portion 127 along the first short edge 109*a*. The resilient base layer 123, and not the wear layer 121, forms the locking edge portion 129 along the second short edge 109*b*. In certain embodiments, the wear layer 121 may form part of the locking edge portion 129, with the resilient base layer 123 primarily forming the locking edge portion 129.

The locking profile 117 of the first short edge 109*a* includes a horizontal locking feature 131, which is formed as part of a channel 133 in the locking profile 117. The channel 133 is formed by a channel floor 135, an outer wall surface 137, and an inner wall surface 139. In this embodiment, the outer wall surface 137 forms the horizontal locking feature 131. The locking profile 117 includes a channel bed thickness 141 measured between the channel floor 135 and the uppermost surface 107 of the floor panel 101. However, the first channel 133 is formed entirely within the resilient base layer 123. With the channel bed thickness 141 partially formed by the wear layer 121, the wear layer 121 helps provide additional stiffness to the horizontal locking feature 131 of this first short edge 109*a*. In certain embodiments, the wear layer 121 forms at least about 5% of the channel bed thickness 141. In other embodiments, the wear layer 121 may form about 12% of the channel bed thickness 141, or even about 30% or more of the channel bed thickness 141.

The locking profile 119 of the second short edge 109*b* includes a horizontal locking feature 143 which is formed to be complementary in shape to the horizontal locking feature 131 of the locking profile 117 of the first short edge 109*a*. The locking profile 119 also includes a vertical ridge 144, which includes an inner wall surface 146 and is formed to be complementary to, and to mate with, the channel 133 of the locking profile 117. In this embodiment, the inner wall surface 146 forms the horizontal locking feature 143 of the floor panel 101. Thus, one floor panel having the first locking profile 117 along a short edge may be coupled in locking engagement with a second floor panel having the second locking profile 119 along a short edge. The two locking profiles 117, 119 along the short edges 109*a*, 109*b* are configured to provide horizontal locking engagement in a manner that is known in the art—the horizontal locking feature inhibits relative horizontal motion between two adjacent floor panels by interlocking vertically formed, or substantially vertically formed, surfaces.

Figure 2B:
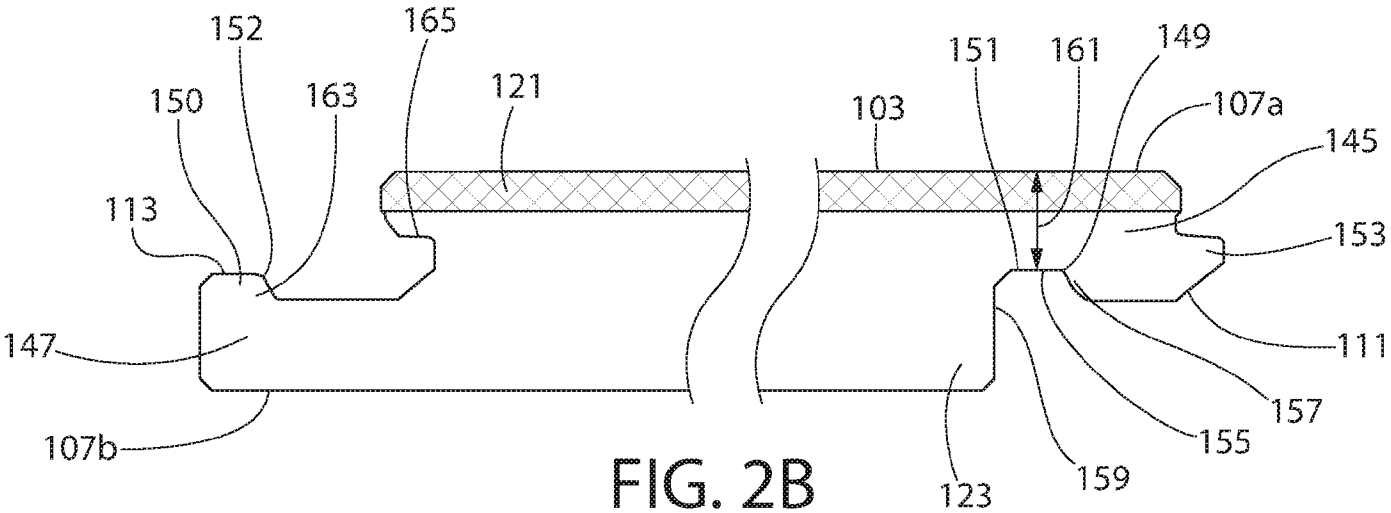
FIG. 2B shows a sectional view of the floor panel along the line 2B-2B of FIG. 1.

As shown in FIG. 2B, the wear layer 121 and the resilient base layer 123, in combination, form the locking edge portion 145 along the first long edge 107*a*. The resilient base layer 123, and not the wear layer 121, forms the locking edge portion 147 along the second long edge 107*b*.

The locking profile 111 of the first long edge 107*a* includes a horizontal locking feature 149, which is formed as part of a channel 151 in the locking profile 111, and a vertical locking feature 153, which is formed as an outward extending tongue 155. The channel 151 is formed by a channel floor 155, an outer wall surface 157, and an inner wall surface 159. In this embodiment, the outer wall surface 157 forms the horizontal locking feature 131. The locking profile 111 includes a channel bed thickness 161 measured between the channel floor 155 and the uppermost surface 107 of the floor panel 101. However, the channel 151 is formed entirely within the resilient base layer 123. With the channel bed thickness 161 partially formed by the wear layer 121, the wear layer 121 helps provide additional stiffness to the horizontal locking feature 169 of this first long edge 107*a*. In certain embodiments, the wear layer 121 forms at least about 5% of the channel bed thickness 161. In other embodiments, the wear layer 121 may form about 12% of the channel bed thickness 161, or even about 30% or more of the channel bed thickness 161.

The locking profile 113 of the second long edge 107*b* includes a horizontal locking feature 163, which is formed to be complementary in shape to the horizontal locking feature 149 of the locking profile 111 of the first long edge 107*a*, and a vertical locking feature 165, which is formed to be complementary in shape to the vertical locking feature 155 of the locking profile 111 of the first long edge 107*a*. The locking profile 113 also includes a vertical ridge 150, which includes an inner wall surface 152 and is formed to be complementary to, and to mate with, the channel 151 of the locking profile 111. In this embodiment, the inner wall surface 152 forms the horizontal locking feature 163 of the floor panel 101. Thus, one floor panel having the first locking profile along a long edge may be coupled in both locking engagement with a second floor panel having the second locking profile along a long edge. The two locking profiles 111, 113 along the long edges 107*a*, 107*b* are configured to provide horizontal and vertical locking engagement in a manner that is known in the art—the horizontal locking feature inhibits relative horizontal motion between two adjacent floor panels by interlocking vertically formed, or substantially vertically formed, surfaces, and similarly, the vertical locking feature inhibits relative vertical motion between the two adjacent floor panels by interlocking horizontally formed, or substantially horizontally formed, surfaces.

With two or more floor panels formed as shown in FIGS. 1, 2A, and 2B, the floor panels may be arranged in a mechanical interlocked arrangement. In such an interlocked arrangement, the first edge portion of each floor panel mates with the second edge portion of adjacent floor panels, with the respective horizontal locking features mating with one another to prevent horizontal separation between the adjacent floor panels, and with the respective vertical locking features mating with one another to prevent vertical separation between the adjacent ones of the floor panels. This type of interlocking with adjacent floor panels may also be achieved with the locking features shown and described in FIGS. 3-6 below.

Figure 3:
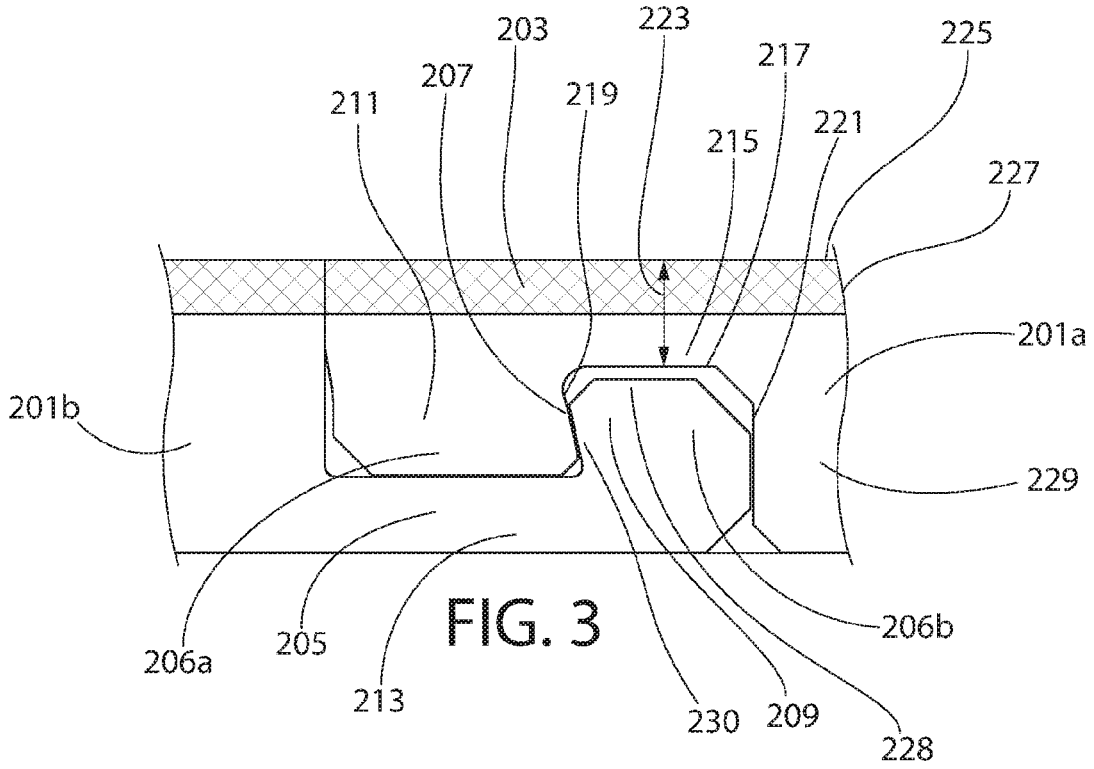
FIG. 3 shows a first alternative locking feature configuration for an interlocking floor panel having a resilient base layer and a wear layer having a higher degree of stiffness.

FIG. 3 shows portions of two floor panels 201*a*, 201*b* having alternative locking features in locking engagement, the locking features being configured for "push-to-lock" engagement. Along respective engaged edges 203, 205, each floor panel 201*a*, 201*b* includes locking profiles 206*a*, 206*b* having a horizontal locking feature 207, 209 and a vertical locking feature 211, 213. Again, the horizontal locking features 207, 209 inhibit relative horizontal motion between the two adjacent floor panels 201*a*, 201*b* by interlocking vertically formed, or substantially vertically formed, surfaces, and similarly, the vertical locking features 211, 213 inhibit relative vertical motion between the two adjacent floor panels 201*a*, 201*b* by interlocking horizontally formed, or substantially horizontally formed, surfaces.

The horizontal and vertical locking features 207, 211 of the first floor panel 201*a* are formed as part of a channel 215. The locking profile 206*a* includes a channel floor 217, an outer wall surface 219, and an inner wall surface 221 to form the channel 215. In this embodiment, the outer wall surface 137 forms both the horizontal locking feature 207 and the vertical locking feature 211. The channel floor 217 has a channel bed thickness 223 between the channel floor 217 and the uppermost surface 225 of the floor panel 201*a*. The channel bed thickness 223 is formed by both the wear layer 227 and the resilient base layer 229, however, the channel 215 is formed entirely within the resilient base layer 229. The wear layer 227 helps provide additional stiffness to the horizontal locking feature 207 of the floor panel 201*a*. As with other embodiments, the wear layer 227 forms at least about 5% of the channel bed thickness 223, and the wear layer 227 may form about 12% of the channel bed thickness 223, or even about 30% or more of the channel bed thickness 223.

The locking profile 206*b* includes a vertical ridge 228, which includes an inner wall surface 230 and is formed to be complementary to, and to mate with, the channel 215 of the locking profile 206*a*. The vertical ridge 228 is formed entirely within the resilient base layer 229, and in this embodiment, the inner wall surface 230 forms both the horizontal locking feature 209 and the vertical locking feature 211 of the floor panel 201*b*. Thus, the first floor panel 201*a* having the first locking profile 206*a* along a long edge may be coupled in locking engagement with a second floor panel 201*b* having the second locking profile 206*b* along a long edge. Thus, the two locking profiles 206*a*, 206*b* are configured to provide horizontal and vertical locking engagement in a manner that is known in the art.

Figure 4:
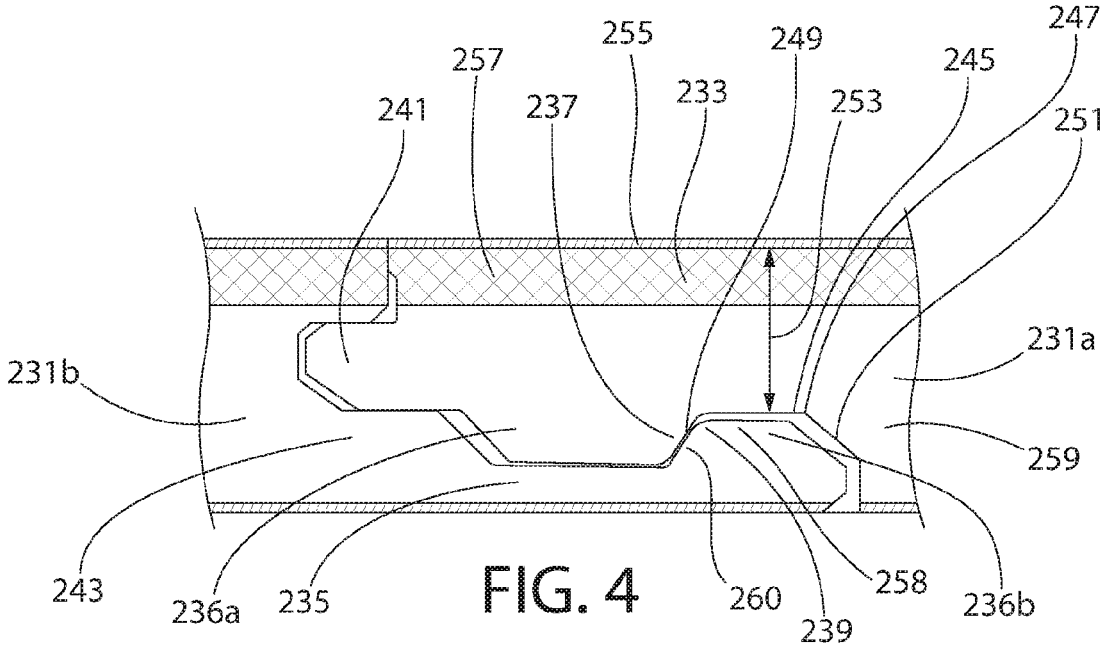
FIG. 4 shows a second alternative locking feature configuration for an interlocking floor panel having a resilient base layer and a wear layer having a higher degree of stiffness.

FIG. 4 shows portions of two floor panels 231*a*, 231*b* having alternative locking features in locking engagement, the locking features being configured for "fold-to-lock" engagement. In the non-limiting embodiment depicted in FIG. 4, the floor panels 231*a*, 231*b* comprise a UV curable coating 255. Along respective engaged edges 233, 235, each floor panel 231*a*, 231*b* includes locking profiles 236*a*, 236*b* having a horizontal locking feature 237, 239 and a vertical locking feature 241, 243. Again, the horizontal locking features 237, 239 inhibit relative horizontal motion between the two adjacent floor panels 231*a*, 231*b* by interlocking vertically formed, or substantially vertically formed, surfaces, and similarly, the vertical locking features 241, 243 inhibit relative vertical motion between the two adjacent floor panels 231*a*, 231*b* by interlocking horizontally formed, or substantially horizontally formed, surfaces.

The horizontal locking feature 237 of the first floor panel 231*a* is formed as part of a channel 245. The locking profile 236*a* includes a channel floor 247, an outer wall surface 249, and an inner wall surface 251 to form the channel 245. In this embodiment, the outer wall surface 249 forms the horizontal locking feature 237. The channel floor 247 has a channel bed thickness 253 between the channel floor 247 and the uppermost surface 253 of the floor panel 231*a*. The channel bed thickness 253 is formed by both the wear layer 257 and the resilient base layer 259, however, the channel 245 is formed entirely within the resilient base layer 259. The wear layer 257 helps provide additional stiffness to the horizontal locking feature 237 of the floor panel 231*a*. As with other embodiments, the wear layer 257 forms at least about 5% of the channel bed thickness 253, and the wear layer 257 may form about 12% of the channel bed thickness 253, or even about 30% or more of the channel bed thickness 253.

The locking profile 236*b* includes a vertical ridge 258, which includes an inner wall surface 260 and is formed to be complementary to, and to mate with, the channel 245 of the locking profile 236*a*. The vertical ridge 258 is formed entirely within the resilient base layer 259, and in this embodiment, the inner wall surface 260 forms the horizontal locking feature 239 of the floor panel 231*b*. Thus, the first floor panel 231*a* having the first locking profile 236*a* along a long edge may be coupled in locking engagement with a second floor panel 231*b* having the second locking profile 236*b* along a long edge. Thus, the two locking profiles 236*a*, 236*b* are configured to provide horizontal and vertical locking engagement in a manner that is known in the art.

Figure 5:
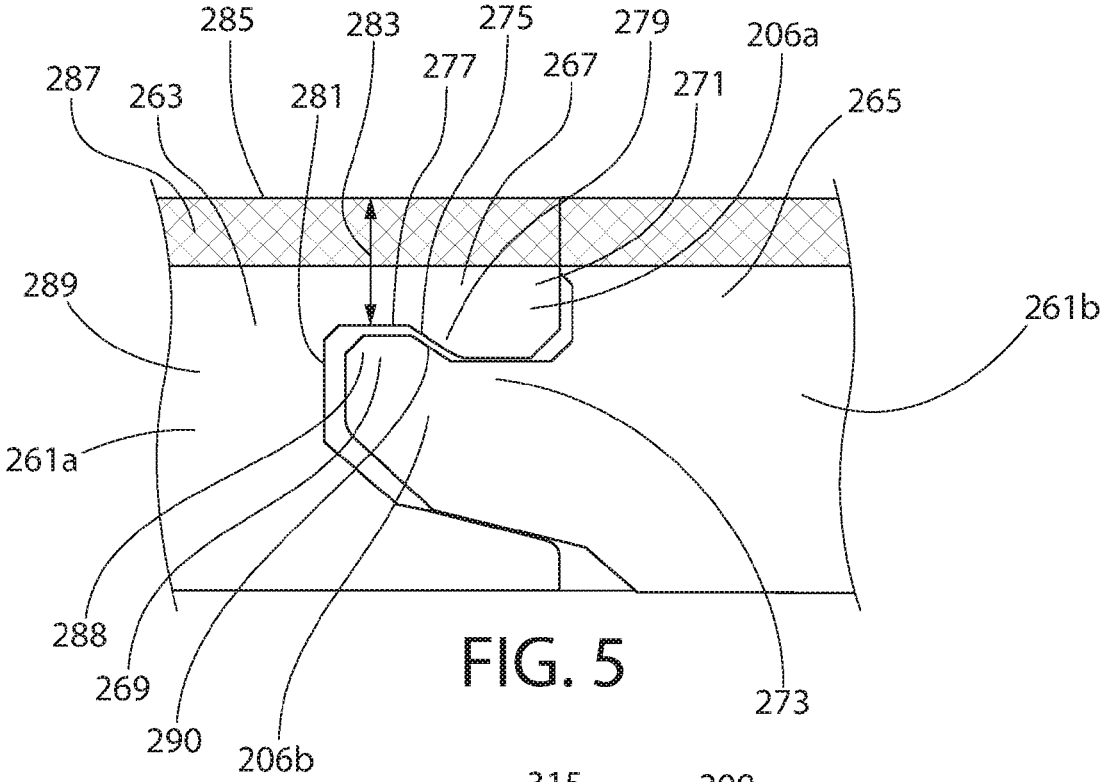
FIG. 5 shows a third alternative locking feature configuration for an interlocking floor panel having a resilient base layer and a wear layer having a higher degree of stiffness.

FIG. 5 shows portions of two floor panels 261*a*, 261*b* having top surface 285 and alternative locking features in locking engagement, the locking features being configured for "fold-to-lock" engagement. Along respective engaged edges 263, 265, each floor panel 261*a*, 261*b* includes locking profiles 266*a*, 266*b* having a horizontal locking feature 267, 269 and a vertical locking feature 271, 273. Again, the horizontal locking features 267, 269 inhibit relative horizontal motion between the two adjacent floor panels 261*a*, 261*b* by interlocking vertically formed, or substantially vertically formed, surfaces, and similarly, the vertical locking features 271, 273 inhibit relative vertical motion between the two adjacent floor panels 261*a*, 261*b* by interlocking horizontally formed, or substantially horizontally formed, surfaces.

The horizontal locking feature 267 of the first floor panel 261*a* is formed as part of a channel 275. The locking profile 266*a* includes a channel floor 277, an outer wall surface 279, and an inner wall surface 281 to form the channel 275. In this embodiment, the outer wall surface 279 forms the horizontal locking feature 267. The channel floor 277 has a channel bed thickness 283 between the channel floor 277 and the uppermost surface 283 of the floor panel 261*a*. The channel bed thickness 283 is formed by both the wear layer 287 and the resilient base layer 289, however, the channel 275 is formed entirely within the resilient base layer 289. The wear layer 287 helps provide additional stiffness to the horizontal locking feature 267 of the floor panel 261*a*. As with other embodiments, the wear layer 287 forms at least about 5% of the channel bed thickness 283, and the wear layer 287 may form about 12% of the channel bed thickness 283, or even about 30% or more of the channel bed thickness 283.

The locking profile 266*b* includes a vertical ridge 288, which includes an inner wall surface 290 and is formed to be complementary to, and to mate with, the channel 275 of the locking profile 266*a*. The vertical ridge 288 is formed entirely within the resilient base layer 289, and in this embodiment, the inner wall surface 290 forms the horizontal locking feature 269 of the floor panel 261*b*. Thus, the first floor panel 261*a* having the first locking profile 266*a* along a long edge may be coupled in locking engagement with a second floor panel 261*b* having the second locking profile 266*b* along a long edge. Thus, the two locking profiles 266*a*, 266*b* are configured to provide horizontal and vertical locking engagement in a manner that is known in the art.

Figure 6:
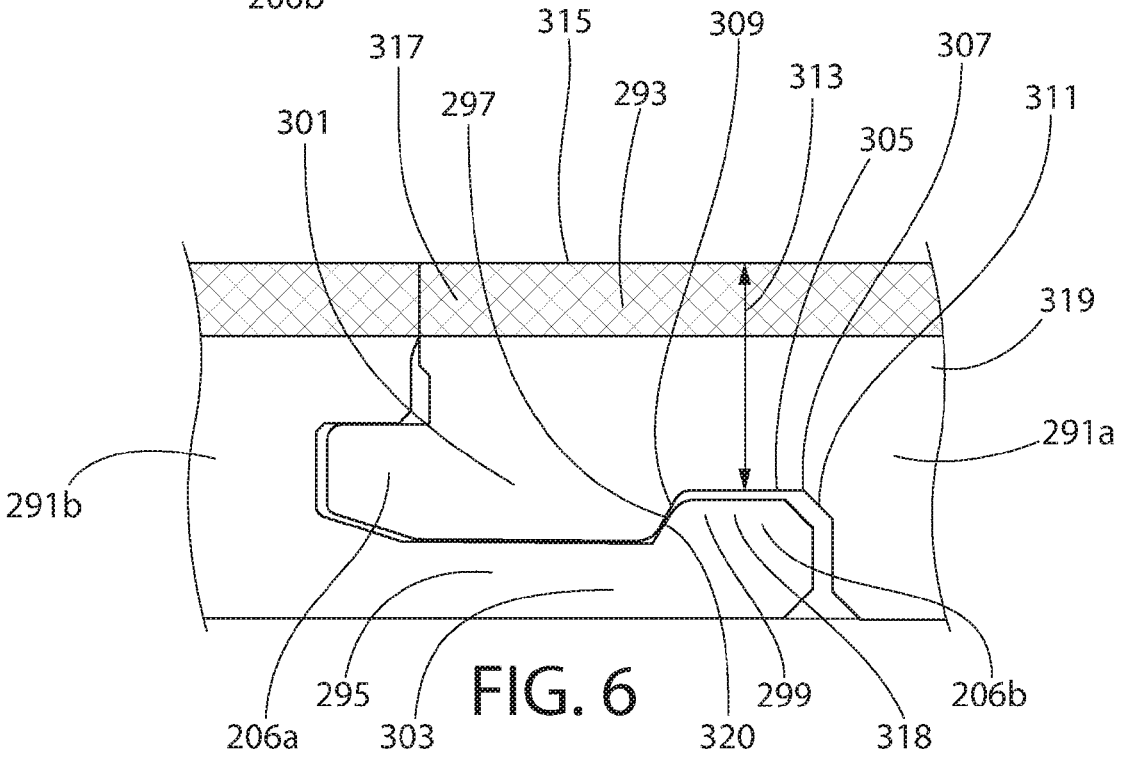
FIG. 6. shows a fourth alternative locking feature configuration for an interlocking floor panel having a resilient base layer and a wear layer having a higher degree of stiffness.

FIG. 6 shows portions of two floor panels 291*a*, 291*b* having top surface 315 and alternative locking features in locking engagement, the locking features being configured for "fold-to-lock" engagement. Along respective engaged edges 293, 295, each floor panel 291*a*, 291*b* includes locking profiles 296*a*, 296*b* having a horizontal locking feature 297, 299 and a vertical locking feature 301, 303. Again, the horizontal locking features 297, 299 inhibit relative horizontal motion between the two adjacent floor panels 291*a*, 291*b* by interlocking vertically formed, or substantially vertically formed, surfaces, and similarly, the vertical locking features 301, 303 inhibit relative vertical motion between the two adjacent floor panels 291*a*, 291*b* by interlocking horizontally formed, or substantially horizontally formed, surfaces.

The horizontal locking feature 297 of the first floor panel 291*a* is formed as part of a channel 305. The locking profile 296*a* includes a channel floor 307, an outer wall surface 309, and an inner wall surface 311 to form the channel 305. In this embodiment, the outer wall surface 309 forms the horizontal locking feature 297. The channel floor 307 has a channel bed thickness 313 between the channel floor 307 and the uppermost surface 313 of the floor panel 291*a*. The channel bed thickness 313 is formed by both the wear layer 317 and the resilient base layer 319, however, the channel 305 is formed entirely within the resilient base layer 319. The wear layer 317 helps provide additional stiffness to the horizontal locking feature 297 of the floor panel 291*a*. As with other embodiments, the wear layer 317 forms at least about 5% of the channel bed thickness 313, and the wear layer 317 may form about 12% of the channel bed thickness 313, or even about 30% or more of the channel bed thickness 313.

The locking profile 296*b* includes a vertical ridge 318, which includes an inner wall surface 320 and is formed to be complementary to, and to mate with, the channel 305 of the locking profile 296*a*. The vertical ridge 318 is formed entirely within the resilient base layer 319, and in this embodiment, the inner wall surface 320 forms the horizontal locking feature 299 of the floor panel 291*b*. Thus, the first floor panel 291*a* having the first locking profile 296*a* along a long edge may be coupled in locking engagement with a second floor panel 291*b* having the second locking profile 296*b* along a long edge. Thus, the two locking profiles 296*a*, 296*b* are configured to provide horizontal and vertical locking engagement.

In some embodiments, the degree of stiffness of the wear layer impacts the performance of the locking profiles described herein. In some embodiments, the wear layer is rigid. In some embodiments, the wear layer is substantially stiff. In some embodiments, the degree of stiffness of the wear layer is modified by the use of a combination of polymers. In some embodiments, the degree of stiffness of the wear layer is modified by combining polymers (same or different) of varying molecular weights. In some embodiments, the degree of stiffness of the wear layer is modified by the use of a filler.

In some embodiments, the wear layer comprises less than 20% plasticizer. In some embodiments, the wear layer comprises less than 15% plasticizer. In some embodiments, the wear layer comprises less than 10% plasticizer. In some embodiments, the wear layer comprises less than 5% plasticizer. In some embodiments, the wear layer comprises less than 3% plasticizer. In some embodiments, the wear layer comprises less than 1% plasticizer. In some embodiments, the wear layer is substantially free of plasticizer. In some embodiments, the wear layer is free of plasticizer.

In some embodiments, the base layer of the floor panel comprises less than 10% plasticizer. In some embodiments, the base layer of the floor panel comprises less than 9% plasticizer. In some embodiments, the base layer of the floor panel comprises less than 8% plasticizer.

EXAMPLE

Example 1

Table 1 (below) describes stiffness data generated from three exemplary surface coverings of the present invention. The data described in Table 1 was generated from an experimental design involving 65 samples with various film and base thicknesses. The film and base thicknesses reported in Table 1 are based on the results of that 65 sample experimental design.

As the data demonstrates, the inventive surface coverings provide an unexpected level of stiffness, when considered in terms of the stiffness provided by the individual components. Specifically, the use of a vinyl film having <20% plasticizer, in combination with a base layer having <10% plasticizer, provides an unexpected increase in stiffness over the stiffness provided by each component individually.

TABLE 1

| | Thickness (mils) | Stiffness/inch (in-lbs/in) |
|---|---|---|
| Film I (w/o plasticizer) | 20 | 14.2 |
| Film II (18% plasticizer) | 20 | 4.2 |
| Base I (7.5% plasticizer) | 100 | 98 |
| Base II (8.8% plasticizer) | 100 | 58 |
| Ex. I | 120 (Base I + Film I) | 245 |
| Ex. II | 120 (Base I + Film II) | 166 |
| Ex. III | 120 (Base II + Film I) | 211 |

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. A floating floor system comprising:

a plurality of floor panels, each of the floor panels comprising:

a base layer having a first thickness and comprising a first plasticizer;

a wear layer atop the base layer, the wear layer having a second thickness and forming an uppermost surface of the floor panel and wherein the wear layer comprises a second plasticizer in an amount less than 10%;

a first locking edge portion having a first locking profile that includes a first channel having a first channel floor, the first locking edge portion being formed by the wear layer and the base layer, the first locking profile further comprising a first channel bed thickness measured between the uppermost surface and the first channel floor, and wherein the wear layer forms at least 5% of the first channel bed thickness; and a second locking edge portion having a second locking profile that includes a second vertical ridge, the second locking edge portion located opposite the first locking edge portion; and wherein the floor panels are arranged in a mechanical interlocked arrangement such that the first edge portions of the floor panels mate with the second edge portions of adjacent ones of the floor panels; and wherein a ratio of the first thickness to the second thickness ranges from about 2:1 to about 5:1.

2. The floating floor system according to claim 1, wherein the wear layer forms between 5% to 30% of the first channel bed thickness.

3. The floating floor system according to claim 1, wherein the wear layer comprises less than 1% plasticizer.

4. The floating floor system according to claim 1, wherein the base layer comprises a vinyl composition.

5. The floating floor system according to claim 1, wherein the second thickness ranges from about 20 mils to about 40 mils.

6. The floating floor system according to claim 1, wherein the first thickness is about 100 mils.

7. The floating floor system according to claim 1, wherein in the mechanical interlocked arrangement, the first locking edge portion and the second locking edge portion interlock adjacent floor panels in a horizontal direction and a vertical direction.

8. The floating floor system according to claim 1, wherein for each of the floor panels, the first channel and the second vertical ridge are formed entirely within the base layer.

9. An interlocking floor panel comprising:

a base layer having a first thickness and comprising a first plasticizer;

a wear layer atop the base layer, the wear layer having a second thickness and forming an uppermost surface of the floor panel and wherein the wear layer comprises a second plasticizer in an amount less than 10%;

a first locking edge portion having a first locking profile that includes a first channel having a first channel floor, the first locking edge portion being formed by the wear layer and the base layer, the first locking profile further comprising a first channel bed thickness measured between the uppermost surface and the first channel floor, and wherein the wear layer forms at least 5% of the first channel bed thickness;

a second locking edge portion having a second locking, the second locking edge portion located opposite the first locking edge portion; and wherein a ratio of the first thickness to the second thickness ranges from about 2:1 to about 5:1.

10. The interlocking floor panel according to claim 9, wherein the wear layer forms from about 5% to about 30% of the first channel bed thickness.

11. The interlocking floor panel according to claim 9, wherein the wear layer comprises less than about 1% plasticizer.

12. The interlocking floor panel according to claim 9, wherein the base layer comprises a vinyl composition.

13. The interlocking floor panel according to claim 9, wherein the second thickness is about 20 mils.

14. The interlocking floor panel according to claim 9, wherein the first thickness is from about 40 mils to about 250 mils.

15. The interlocking floor panel according to claim 9, wherein the first thickness is about 100 mils.

16. The interlocking floor panel according to claim 9, wherein the first locking edge portion comprises at least one of first horizontal locking feature, a first vertical locking feature, and a combination thereof, wherein the second locking edge portion is complementary in shape to the first locking edge portion.

17. The interlocking floor panel according to claim 9, wherein the first channel and the second vertical ridge are formed entirely within the base layer.

18. An interlocking floor panel comprising:

a linoleum base layer;

a vinyl wear layer atop the linoleum base layer, the vinyl wear layer forming an uppermost surface of the interlocking floor panel;

a first locking edge portion having a first locking profile that includes a first channel having a first channel floor, the first locking edge portion being formed by the vinyl wear layer and the linoleum base layer, the first locking profile further comprising a first channel bed thickness measured between the uppermost surface and the first channel floor; and a second locking edge portion having a second locking profile, the second locking edge portion located opposite the first locking edge portion.

19. The interlocking floor panel according to claim 18, wherein the vinyl wear layer comprises less than 1% plasticizer.

* * * * *